United States Patent [19]

Oda et al.

[11] Patent Number: 4,498,962

[45] Date of Patent: Feb. 12, 1985

[54] ANODE FOR THE ELECTROLYSIS OF WATER

[75] Inventors: Yoshio Oda; Hiroshi Otouma; Eiji Endoh, all of Yokohama, Japan

[73] Assignee: Agency of Industrial Science and Technology, Tokyo, Japan

[21] Appl. No.: 539,952

[22] Filed: Oct. 7, 1983

[30] Foreign Application Priority Data

Jul. 10, 1982 [JP] Japan ..... 57-175376
Oct. 7, 1982 [JP] Japan ..... 57-175375

[51] Int. Cl.[3] ..... C25B 1/02; C25B 11/08

[52] U.S. Cl. ..... 204/129; 204/290 R; 204/290 F; 204/291; 204/292; 204/293

[58] Field of Search ..... 204/290 R, 290 F, 291–293, 204/129

[56] References Cited

U.S. PATENT DOCUMENTS 4,300,992 11/1981 Yoshida et al. ..... 204/291
4,368,110 1/1983 Caldwell et al. ..... 204/291
4,421,626 12/1983 Stachurski et al. ..... 204/290 R

*Primary Examiner*—R. L. Andrews
*Attorney, Agent, or Firm*—Oblon, Fisher, Spivak, McClelland & Maier

[57] ABSTRACT

A cell for the electrolysis of water comprising an anode and a cathode wherein said anode comprises an electrode substrate and a coating layer formed on the substrate, said coating layer being made of an electrochemically active material comprising Component X selected from the group consisting of nickel, cobalt and mixture thereof, Component Y selected from the group consisting of aluminum, zinc, magnesium and silicon and Component Z selected from the group consisting of a noble metal and rhenium.

9 Claims, 5 Drawing Figures

ANODE FOR THE ELECTROLYSIS OF WATER

BACKGROUND OF THE INVENTION

1. Field of the Invention

The present invention relates to an anode for the electrolysis of water, which has high durability and low oxygen overvoltage. More particularly, the present invention relates to an anode which hardly undergoes degradation of its properties even when subjected to an oxidizing environment and which has a low oxygen overvoltage characteristic.

2. Description of the Prior Art

Various types of anodes have been proposed as anodes having low oxygen overvoltage, particularly as anodes for electrolysis of water in an aqueous alkaline solution.

As an industrial process for the production of oxygen and hydrogen, it is well known to obtain oxygen gas from an anode compartment and hydrogen gas from a cathode compartment in the electrolysis of water in an aqueous alkaline solution in an electrolytic cell. As an anode for such an electrolytic cell, it is preferred to use iron, nickel or Raney nickel.

However, the oxygen overvoltage of such an anode is not low enough. In the case of nickel or cobalt, the overvoltage tends to increase as time passes. The present inventors have studied this phenomenon, and finally found that the nickel or cobalt surface as an electrochemically active component is converted to nickel hydroxide or cobalt hydroxide, whereby the electrochemical activity is deteriorated, i.e. the oxygen overvoltage increases. Further, it has been found that this deterioration can effectively be prevented by incorporating a third component selected from the group consisting of a noble metal and rhenium into known metal particles comprising a first component such as nickel or cobalt and a second component such as aluminum, zinc, magnesium or silicon, and that not only such metal particles but also an electrode having a surface layer having the same composition is equally effective. The present invention has been accomplished based on these discoveries.

SUMMARY OF THE INVENTION

The present invention provides an anode having high durability and low oxygen overvoltage comprising an electrode substrate and a coating layer formed thereon, characterized in that the coating layer is made of an electrochemically active material comprising Component X selected from the group consisting of nickel, cobalt and a mixture thereof, Component Y selected from the group consisting of aluminum, zinc, magnesium and silicon, and Component Z selected from the group consisting of a noble metal and rhenium.

The present invention also provides a process for producing an anode having high durability and low oxygen overvoltage, which comprises applying onto an electrode substrate an electrochemically active material comprising Component X selected from the group consisting of nickel, cobalt and a mixture thereof, Component Y selected from the group consisting of aluminum, zinc, magnesium and silicon, and Component Z selected from the group consisting of a noble metal and rhenium, by depositing particles of said electrochemically active material on the electrode substrate by a composite coating method, or forming an uniform layer of said electrochemically active material on the electrode substrate by a coating method, a dipping method or a sintering method.

DETAILED DESCRIPTION OF THE PREFERRED EMBODIMENTS

Now, the present invention will be described in detail with reference to the preferred embodiments.

In the accompanying drawings.

In the present invention, the noble metal is meant for gold, silver and a platinum group metal such as platinum, rhodium, ruthenium, palladium, oxmium or iridium, as is well known.

The coating layer may be a uniform layer of said chemically active material or it may be composed of particles of said chemically active material. Or, the coating layer may be composed of a uniform layer of a bonding metal and particles of said electrochemically active material embedded in and partially exposed from the uniform layer. In this case, the bonding metal may be composed of said electrochemically active material, or it may be nickel, cobalt or silver.

The electrochemically active material may be an alloy of Components X, Y and Z, or it may be a mixture of an alloy of Components X and Y and a metal of Component Z or its alloy or oxide.

Figure 1:
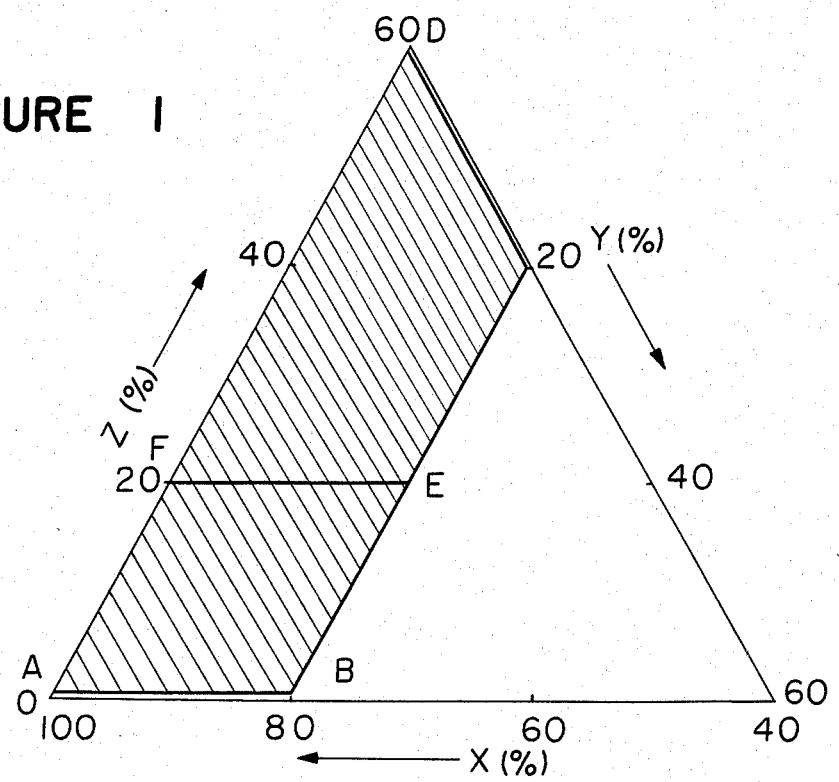
FIG. 1 is a diagram of a three-component composition comprising X=Ni or Co, Y=Al, Zn, Mg, or Si and Z=a noble metal or rhenium, and the composition within the range defined by points A, B, C and D represents the electrochemically active alloy composition of the coating layer of the anode according to the present invention.

FIG. 1 is a diagram of the three-component alloy composition comprising Component X selected from the group consisting of nickel, cobalt and a mixture thereof, Component Y selected from the group consisting of aluminum, zinc, magnesium and silicon, and Component Z selected from the group consisting of a noble metal and rhenium. The alloy composition of the coating layer of the anode according to the present invention is preferably within the range defined by points A, B, C and D of FIG. 1. The alloy composition is more preferbly within the range defined by points A, B, E and F.

The proportions of Components X, Y and Z at points A, B, C and D are as follows.

| | | | |
|---|---|---|---|
| A: | X = 99.6 wt. %, | Y = 0 wt. %, | Z = 0.4 wt. % |
| B: | X = 79.6 wt. %, | Y = 20 wt. %, | Z = 0.4 wt. % |
| C: | X = 40 wt. %, | Y = 20 wt. %, | Z = 40 wt. % |
| D: | X = 40 wt. %, | Y = 0 wt. %, | Z = 60 wt. % |

Likewise, the proportions of Components X, Y and Z at points A, B, E and F are as follows:

| | | | |
|---|---|---|---|
| A: | X = 99.6 wt. %, | Y = 0 wt. %, | Z = 0.4 wt. % |
| B: | X = 79.6 wt. %, | Y = 20 wt. %, | Z = 0.4 wt. % |
| E: | X = 60 wt. %, | Y = 20 wt. %, | Z = 20 wt. % |
| F: | X = 80 wt. %, | Y = 0 wt. %, | Z = 20 wt. % |

The effect of the present invention is obtained by incorporating a component selected from the group consisting of a noble metal and rhenium, as one component of the alloy composition. The reason why the formation of nickel hydroxide or cobalt hydroxide is prevented by the incorporation of this component, has not yet been clearly understood. However, it has been confirmed that among the metals of this component, rhodium and iridium are most effective to provide the effect of the present invention. Namely, when rhodium or iridium is used, it is possible to maintain the oxygen overvoltage at an extremely low level for a long period of time even under a severe environmental condition.

The alloy for the anode of the present invention should preferably have a composition within the range defined by points A, B, C and D of FIG. 1 because if the alloy has a composition outside the above range, there will be disadvantages such that the oxygen overvoltage can not be maintained at a low level for an extended period of time or the oxygen overvoltage tends to be high from the beginning, or even if a noble metal or rhenium is added in a great amount exceeding this range, no further reduction of the oxygen overvoltage or no further improvement in the durability can be expected.

When the above alloy is in particle form, the average particle size may usually be in a range of 0.1 to 100 μm although it depends upon the porosity of the electrode surface and the dispersibility of the particles for the production of an electrode, which will be described hereinafter.

Within the above range, the particle size is preferably from 0.9 to 50 μm, more preferably from 1 to 30 μm, from the viewpoint of e.g. the porosity of the electrode surface.

Further, the alloy layer of the present invention is preferably porous at its surface so as to provide low oxygen overvoltage.

In the case where the alloy is in particle form, the porous surface does not necessarily mean that the entire surface of the particles is porous, and it is sufficient that only the portions of the surface exposed on the above-metnioned coating layer are porous. In the case where the alloy is provided on the electrode substrate in the form of a layered structure such as a plated layer, the porosity may be provided by the irregularities, i.e. concavities and convexities, of the layer surface.

In general, the greater the porosity, the better. However, an excessive porosity tends to lead to poor mechanical strength. Accordingly, the porosity is preferably from 20 to 90%. Within this range, the porosity is more preferably from 35 to 85%, particularly from 50 to 80%.

The porosity is measured by a conventional water substituting method. Various methods may be employed to form a porous surfce. Whether or not the alloy is in particle form, it is preferred to employ a method wherein the porosity is provided, for instance, by partially or entirely removing Component Y from an alloy comprising Components X, Y and Z.

In this case, it is particularly preferred to employ a method which comprises treating an alloy comprising predetermined proportions of uniformly distributed Components X, Y and Z, with an alkali metal hydroxide to remove at least partially the metal of Component Y. In the case of the anode of the present invention, it is not necessarily required to pretreat it with an alkali hydroxide prior to mounting it in the electrolytic cell, since the anolyte is a solution of an alkali metal hydroxide, and the metal of Component Y is gradually removed during the electrolysis, whereby a desired anode is obtainable.

Various combinations may be used as the composition of the above-mentioned metal particles. Typical combinations include Ni-Al-Rh, Ni-Al-Ir, Ni-Zn-Rh, Ni-Zn-Ir, Ni-Si-Rh, Ni-Si-Ir, Co-Al-Rh, Co-Al-Ir, Co-Zn-Rh, Co-Zn-Ir, Co-Si-Rh, Co-Si-Ir, Ni-Mg-Rh, Ni-Mg-Ir, Co-Mg-Rh and Co-Mg-Ir.

Particularly preferred combinations among them are Ni-Al-Rh, Ni-Al-Ir, Co-Al-Rh and Co-Al-Ir.

The conditions for the alkali metal hydroxide treatment may vary depending upon the composition of the particular alloy. However, in the case of the alloy having the composition mentioned hereinafter, it is preferred to immerse it in an aqueous solution having an alkali metal hydroxide concentration (as calculated as NaOH) of from 10 to 35% by weight at a temperature of from 10° to 50° C. for from 0.5 to 3 hours. These conditions are selected to readily remove Component Y.

Further, Component Z is the one which is not removed by the above-mentioned alkali treatment.

In the case where the above-mentioned alloy is in particle form, the bonding layer is preferably made of the same metal as Component X of the alloy particles so that the particles are thereby firmly bonded to the metal substrate.

Thus, in the case where the alloy is in particle form, numerous alloy particles are bonded on the electrode surface of the anode of the present invention, whereby the surface of the anode macroscopically presents a fine porous structure.

In the case where the surface of the electrode substrate is uniformly coated with an alloy layer, no binder metal layer exists as opposed to the case where the alloy particles are used.

Thus, in the anode of the present invention, the electrode surface is covered with an alloy containing nickel and/or cobalt having by itself a low oxygen overvoltage, and, as mentioned above, the electrode surface has a fine porous structure to present a larger electrochemically active surface area, whereby the oxygen overvoltage can be effectively reduced by the synergistic effect.

Further, in the case where the alloy particles are used in the present invention, they are firmly bonded to the electrode surface by the layer composed of the above-mentioned metal, whereby deterioration due to the falling off of the bonded particles is minimized and the superior effect for the maintenance of the low oxygen overvoltage will be ensured.

In the present invention, the electrode substrate can be made of a suitable electroconductive metal such as Ti, Zr, Fe, Ni, V, Mo, Cu, Ag, Mn, platinum group metals, graphite and Cr, and alloys thereof. Among them, it is preferred to use Fe, a Fe-alloy (a Fe-Ni alloy, a Fe-Cr alloy or a Fe-Ni-Cr alloy), Ni or a Ni-alloy (a Ni-Cu alloy or a Ni-Cr alloy). Particularly preferred materials for the electrode substrate are Ni, a Fe-Ni alloy and a Fe-Ni-Cr alloy.

The size and configuration of the electrode substrate may be optionally adjusted to conform with the structure of the electrode to be used. For instance, the substrate may be in the form of a plate, a foraminous sheet, a net (such as an expanded metal) or a parallel screen type, which may be flat, curved or cylindrical.

The thickness of the coating layer of the present invention is preferably from 20 to 200 μm, more preferably from 25 to 150 μm, particularly from 30 to 100 μm.

Figure 2:
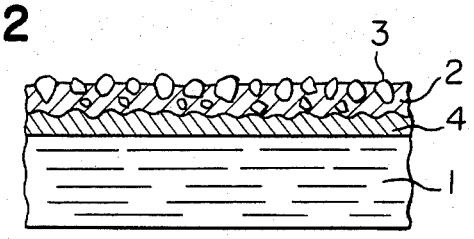
FIG. 2 is a cross sectional view of the surface portion of an anode of the present invention.
Figure 3:
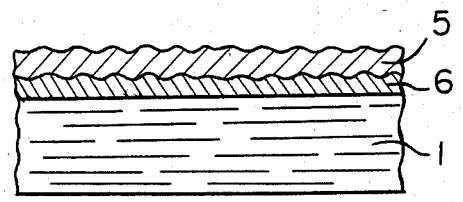
FIG. 3 is a cross sectional view of the surface portion of another anode according to the present invention.

FIGS. 2 and 3 illustrate cross sections of the electrode surfaces according to the present invention. As shown in FIG. 2, a metal layer 2 is formed on an electrode substrate 1 with a middle layer 4 interposed between them. The metal layer contains electrochemically active metal particles 3, and the metal particles are partially exposed on the surface of the layer. The proportion of the particles in the layer 2 is preferably from 5 to 80% by weight, more preferably from 10 to 50% by weight. The durability of the electrode of the present invention can be further improved by providing a middle layer composed of a metal selected from the group consisting of Ni, Co and Ag, between the electrode substrate and the metal layer containing electrochemically active particles. Such a middle layer may be made of the same or different metal as the metal in the above-mentioned metal layer. However, in view of the bonding property of the middle layer with the above-mentioned metal layer, it is preferred that the middle layer is made of the same metal as the above-mentioned metal layer. From the viewpoint of e.g. the mechanical strength, the thickness of the middle layer is preferably from 5 to 100 μm, more preferably from 20 to 80 μm, particularly from 30 to 50 μm.

However, it is not essential to provide such a middle layer.

FIG. 3 is a cross sectional view of the anode of the present invention wherein the surface of the electrode substrate is uniformly coated with an alloy layer. Reference numeral 1 designates an electrode substrate, numeral 5 designates a uniform surface layer made of an electrochemically active alloy, and numeral 6 designates a middle layer.

In the electrode of the present invention as illustrated in FIG. 2, numerous particles are exposed on the electrode surface, whereby the porosity of the surface layer is mainly provided by the spaces between the particles, and the voids formed by the removal of Component Y of the alloy also contribute to the porosity.

Figure 5:
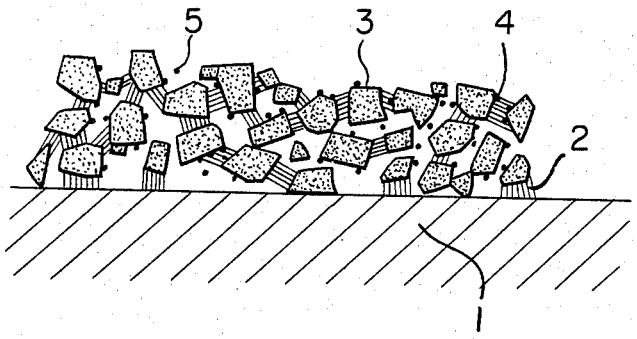
FIG. 5 is a cross sectional view of the surface portion of still another anode of the present invention.

FIG. 5 illustrates another embodiment of the present invention in which the coating layer is composed of a bonding metal layer 2, alloy particles 3 of Components X and Y and noble metal particles 4 of Component Z or its alloy or oxide. The bonding metal layer 2 may be composed of nickel, cobalt or silver, or the above-mentioned electrochemically active material. The alloy particles 3 of Components X and Y are composed of electrically conductive material such as Raney nickel, Raney cobalt and Raney silver. The noble metal particles 4 of Component Z are preferably composed of rhodium, iridium or an alloy or oxide thereof. In the case of rhodium, rhodium black is particularly preferred which is obtained by reducing rhodium chloride with sodium boron hydride under an alkaline condition. In the case of iridium, iridium black is particularly preferred which is obtained by reducing iridium chloride with dimethylamine borane. Other noble metal particles obtainable by the reduction with formaline or hydrazine or by subjecting their chlorides to vapor phase pyrolysis or hydrogenation reduction, may also be used.

As mentioned above, the degree of the porosity relates to the reduction of oxygen overvoltage, and it is sufficient for the purpose of the present invention if it provides an electrical double layer capacity of at least 1000 $\mu F/cm^2$. Within this range, the electrical double layer capacity is preferably at least 2000 $\mu F/cm^2$, more preferably at least 5000 $\mu F/cm^2$.

The electrical double layer capacity is an electrostatic capacity of the electrical double layers formed by the positive and negative ions distributed in a face-to-face relationship with a short distance from each other near the surface of the electrode when the electrode is immersed in an electrolyte, and it is measured as a differential capacity.

The capacity increases with an increase of the surface area of the electrode. Accordingly, with an increase of the porosity of the electrode surface and the consequential increase of the surface area of the electrode, the electrical double layer capacity of the electrode surface increases. Thus, the electrochemically effective surface area of the electrode i.e. the degree of the porosity of the electrode surface can be determined by the electrical double layer capacity.

The electrical double layer capacity varies depending upon the temperature at the time of the measurement, the kind and concentration of the electrolyte and the electrode potential, and for the purpose of the present invention, the electrical double layer capacity is meant for the values measured by the following method.

A test piece (i.e. an electrode) is immersed in an aqueous solution (25° C.) containing 40% by weight of NaOH and a platinum black coated platinum plate having an apparent surface area of about 100 times the surface area of the test piece is immersed as a counter electrode, whereby a cell-impedance is measured by a vector-impedance meter to obtain the electrical double layer capacity of the test piece.

Various methods may be used for practically forming the surface layer on the electrode. For instance, a composite coating method, a melt-coating method, a sintering method, an alloy plating method or a melt-dipping method may be employed.

When metal particles are used, it is particularly preferred to employ a composite coating method, since the particles of the present invention can thereby effectively be coated on the electrode surface, and the coating layer thereby formed will have pores or voids, as illustrated in FIG. 5, whereby the gas and liquid passages in the layer will be facilitated.

The composite coating method is conducted in such a manner that into an aqueous solution containing a kind of metal ions to form the metal layer, alloy particles mainly composed of e.g. nickel are dispersed to obtain a plating bath, and electroplating is carried out in the plating bath by using an electrode substrate as a cathode so that the above metal and the alloy particles are co-electrodeposited on the electrode substrate. More specifically, the particles in the bath are considered to become bipolar by the influence of the electric field, and when they approach close to the surface of the cathode, the local cathode current density increases and when they get in contact with the cathode, they are co-electrodeposited with the metal on the substrate by the reduction of the metal ions. For instance, when a nickel layer is used as the metal layer, a nickel chloride bath, a high nickel chloride bath or a nickel chloride-nickel acetate bath may be employed. When a cobalt layer is used as a metal layer, cobalt chloride bath, a high cobalt chloride bath or a cobalt chloride-cobalt acetate bath may be employed.

In this case, the pH of the bath is important. Namely, in many cases, it is usual that oxygen is deposited or certain oxide films are formed on the surface of electrochemically active metal particles to be dispersed in the plating bath. In such a state, the bonding strength of the particles with the metal layer will be inadequate, and consequently, it will be likely that the particles will fall off during the use as an electrode. In order to prevent this from happening, it is necessary to minimize the oxygen deposition or the formation of oxide films on the surface of the particles. For this purpose, it is preferred to adjust the pH of the plating bath to be from 1.5 to 3.0.

In the process of the present invention, the metal particles are made of an electrochemically active material comprising Component X selected from the group consisting of nickel, cobalt and a mixture thereof, Component Y selected from the group consisting of aluminum, zinc, magnesium and silicon, and Component Z selected from the group consisting of a noble metal and rhenium.

Figure 4:
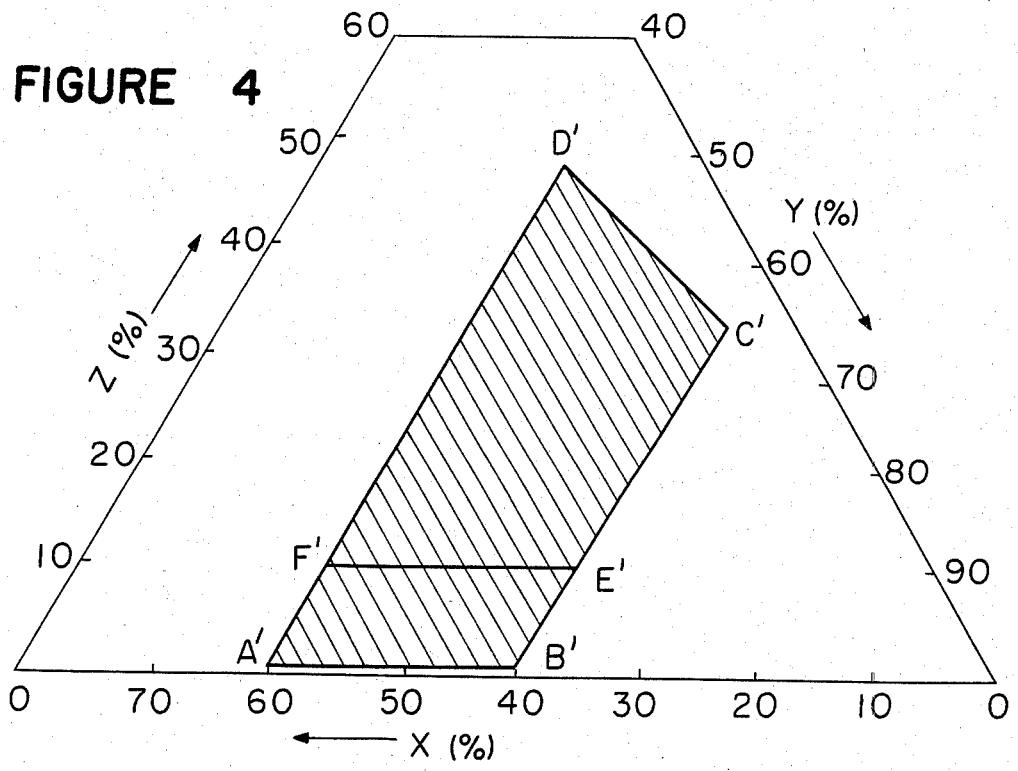
FIG. 4 is a diagram of a three-component composition comprising X=Ni or Co, Y=Al, Zn Mg or Si and Z=a noble metal or rhenium, and the composition within the range of points A′, B′, C′ and D′ represents the composition of the electrochemically active alloy to be used in the process of the present invention.

In a preferred embodiment, the metal particles are made of an alloy having a composition falling within the range defined by points A', B', C' and D' of FIG. 4.

The proportions of the alloy Components (X, Y and Z) at point A', B', C' and D' in FIG. 4 are as follows:

| | | | |
|---|---|---|---|
| A': | X = 59.8 wt. %, | Y = 40 wt. %, | Z = 0.2 wt. % |
| B': | X = 39.8 wt. %, | Y = 60 wt. %, | Z = 0.2 wt. % |
| C': | X = 5 wt. %, | Y = 60 wt. %, | Z = 35 wt. % |
| D': | X = 12 wt. %, | Y = 40 wt. %, | Z = 48 wt. % |

The composition is more preferably within the range defined by points A', B' E' and F'. The proportions of Components X, Y and Z at points A', B', E' and F' are as follows:

| | | | |
|---|---|---|---|
| A': | X = 59.2 wt. %, | Y = 50 wt. %, | Z = 0.2 wt. % |
| B': | X = 39.8 wt. %, | Y = 60 wt. %, | Z = 0.2 wt. % |
| E': | X = 30 wt. %, | Y = 60 wt. %, | Z = 10 wt. % |
| F': | X = 50 wt. %, | Y = 40 wt. %, | Z = 10 wt. % |

If the composition is outside the above range, there will be disadvantages such that no adequate deposition tends to be secured by the composite coating process, no adequate bonding strength will be obtained even when an adequate amount has been co-deposited, or the electrochemical catalytic activity of the electrode after the extraction of Component Y will be inadequate. Further, even when the amount of the noble metal exceeds the range of the present invention, no additional effectiveness for the reduction of the oxygen overvoltage or no further improvement of the durability will be thereby obtained.

When the composite coating is conducted in a plating bath in which alloy particles are dispersed, the amount of the particles in the bath is preferably from 1 to 200 g/l, more preferably from 1 to 50 g/l, particualarly from 1 to 10 g/l in order to ensure good bonding of the particles to the electrode surface. Further, the composite coating operation is preferably conducted at a temperature of from 20° to 80° C., particularly from 30° to 60° C. at a current density of 1 to 20 A/dm$^2$, particularly from 1 to 10 A/dm$^2$.

In another embodiment of the composite coating process, alloy particles of Component X and Y, such as Raney nickel, Raney cobalt or Raney silver particles, and noble metal particles of Component Z, such as rhodium black or iridium black particles, are uniformly dispersed in the plating bath. In this case, the noble metal particles are used normally in an amount of from 0.1 to 10 g/l, as calculated as the noble metal element, depending upon the amount of the alloy particles of Components X and Y which are added at the same time. The alloy particles of Components X and Y are used normally in an amount of from 0.5 to 6 cc/l. This amount corresponds to from 2.1 to 25 g/l, in the case of Raney nickel alloy particles (particle density: 4.2 g/cm$^3$). The composite coating operation in this case is preferably conducted at a temperature of from 20° to 80° C. at a current density of from 0.05 to 5 A/dm$^2$ at a pH of the plating bath being from 1 to 3. When a silver bath is used as the plating bath, the pH is preferably from 8 to 13.

Further, additives such as an additive to reduce the strain of the coating or an additive to facilitate co-electrodeposition may optionally be added to the plating bath.

When a middle layer is to be formed between the electrode substrate and the particle-containing metal layer as mentioned above, the electrode substrate is firstly palted with Ni, Co or C, and then the particle-containing metal layer is formed thereon by the above-mentioned composite coating method or melt-spraying method.

In such a case, the above-mentioned various plating baths may be employed as the plating bath. In the case of the Cu plating, conventional plating baths may be employed.

Thus, it is possible to obtain an electrode wherein the particles of the present invention are co-deposited on the electrode substrate with the metal layer interposed between them.

Now, specific methods for forming a uniform electrochemically active alloy layer on the electrode substrate will be described.

The specific methods include a coating method, a dipping method, a sintering method and an electroplating method, as mentioned above.

As the coating method, it is preferred to employ a method wherein a slender rod or powder of the alloy as shown in FIG. 4 is melted and sprayed. For this melt spraying, there may be employed a plasma spray apparatus or an oxygen-hydrogen flame or oxygen-acetylene flame spray apparatus which is commonly used in a melt-coating method.

The dipping method is a method wherein an electrode substrate is dipped in a molten liquid of the above-mentioned alloy to form a coating layer of the alloy on the substrate, whereby the temperature of the molten alloy liquid is preferably higher by from 50° to 200° C. than the melting point of said alloy. For instance, in the case of Ni-Al-Ru, the melting point is about 1500° C., and accordingly the dipping is conducted at a temperature of about 1600° C. and a coating layer of the alloy is formed on the electrode substrate when the dipped substrate is taken out.

The sintering method is a method wherein preliminarily prepared fine particles having a particle size of not greater than 100 μm are coated on the electrode substrate by using a suitable polymer, particularly, an aqueous solution of a water-soluble polymer, and then heated to burn off the binder and to sinter the particles and bond them to the substrate. Usually, the operation is conducted at a temperature lower by from 100° to 300° C. than the melting point, and the sintering is preferably conducted under elevated pressure.

The electroplating method is a so-called alloy plating method wherein a solution (preferably an aqueous solution) of metal salt, of which Components X, Y and Z fall within the range shown in FIG. 4, is prepared, and an electrode substrate is immersed as a cathode in the solution thereby to conduct electroplating. However, when Component Y is Al or Mg, this method can not be employed. This method can be employed when Component Y is Zn. Commonly employed conditions may be used as the plating conditions. For instance, the electroplating may be conducted at a temperature of about 60° C. at a current density of about 1 $A/dm^2$ in a solution of the mixture of $NiSO_4.7H_2O$, $ZnSO_4$, $KReO_4$ and $(NH_4)_2SO_4$ with its pH adjusted at 4.0, whereby an alloy layer of Ni-Zn-Re can be formed.

It is also effective to deposit a non-electronic conduction substance on the surface of the low oxygen voltage anode thus obtained.

When the anode of the present invention is used as an anode for electrolysis of water in an aqueous alkaline solution, it sometimes happens that the anolyte contains silicic acid ions and these ions discharge on the anode to precipitate silica on the anode. In such a case, the electrochemical activity of the anode surface will be lost and consequently the oxygen overvoltage will increase.

In order to prevent such precipitation, it is effective to partially deposit an electrically nonconductive substance such as a fluorine-containing resin (for example, PTFE) on the anode of the present invention or on the metal particles exposed on the anode surface. As a specific method for this purpose, it is preferred to employ a method as disclosed in Japanese patent application No. 126921/1981.

If necessary, the anode thus obtained may be subjected to treatment with an alkali metal hydroxide (for instance, by immersing it in an aqueous alkali metal hydroxide solution) to remove at least partially the metal of Component Y in the alloy particles and to form a porous structure on the particles or on the surface layer of the electrode.

The conditions for such treatment are as described above.

When an alloy comprising the above-mentioned Components X, Y and Z is used, it is preferred to conduct the above-mentioned alkali metal hydroxide treatment. However, the electrode coated with such an alloy may be mounted on an electrolytic cell as it is, i.e. without subjecting it to the alkali metal hydroxide treatment and subjected to the electrolysis so that such treatment is conducted during the electrolysis.

In such a case, the metal of Component Y dissolves during the process of the electrolysis, whereby the electrode overvoltage will be reduced. Although the resulting aqueous alkali metal hydroxide solution may be slightly contaminated with the dissolved metal ions of Component Y, such contamination is usually negligible and does not create a problem.

The electrode of the present invention can be used as an anode for the electrolysis of water in an aqueous alkaline solution in a solid electrolyte process or in an ion exchange membrane process. It may be used also as an anode for electrolysis of water in an aqueous alkaline solution by means of a porous diaphragm such as an asbestos diaphragm.

Now, the present invention will be described in further detail with reference to Examples.

EXAMPLES 1 to 12

Alloy powders (200 mesh pass) having the compositions as identified in Table 1 were prepared. With respect to Examples 1 to 10, low oxygen overvoltage electrodes were prepared by a composite coating method in accordance with Example 12 of Japanese unexamined patent publication No. 112785/1979. With respect to Examples 11 to 12, low oxygen overvoltage electrodes were prepared by a composite coating method in accordance with Example 12 of the same publication except that the coating method was modified by replacing $NiCl_2.6H_2O$ and the Ni plate anode by $CoCl_2.6H_2O$ (concentration: 300 g/l) and a Co palte anode, respectively. (However, the leaching treatment after the plating was conducted at a temperature of 50° C.)

With respect to each electrode thus obtained, the metal particles on the electrode were partially sampled and their composition was examined. The results are shown in Table 1.

Then, tests for the electrolysis of water were conducted by using these electrodes as anodes for an aqueous alkaline electrolytic cell wherein a nickel expanded metal was used as the cathode and a fluorine-containing cation exchange membrane (a copolymer of $CF_2=CF_2$ with $CF2=CFO(CF_2)_3COOCH_3$ manufactured by Asahi Glass Company Ltd., an ion-exchange capacity of 1.45 meq/g resin) was used as an ion-exchange membrane. Electrolysis was conducted at 110° C. at a current density of 70 $A/cm^2$ using a 15% KOH solution as the electrolyte. The results of the measurement of the oxygen overvoltage and the cell voltage are shown in Table 1.

Table 1

| Examples | X (%) | | Y (%) | | Z (%) | | Oxygen overvoltage | Cell voltage | Composition after the NaOH treatment (%) | | |
|---|---|---|---|---|---|---|---|---|---|---|---|
| No. | Ni | Co | Al | Zn | Rh | Ir | (V) | (V) | X | Y | Z |
| 1 | 49.7 | | 50 | | 0.3 | | 0.28 | 1.94 | 93.5 | 6 | 0.5 |
| 2 | 49.5 | | 50 | | 0.5 | | 0.27 | 1.93 | 91.2 | 8 | 0.8 |
| 3 | 45 | | 50 | | 5 | | 0.26 | 1.92 | 84 | 8 | 8 |
| 4 | 40 | | 50 | | 10 | | 0.25 | 1.91 | 88 | 5 | 17 |
| 5 | 35 | | 55 | | 10 | | 0.26 | 1.92 | 70 | 10 | 20 |
| 6 | 45 | | 45 | | 10 | | 0.25 | 1.91 | 74 | 10 | 16 |
| 7 | 45 | | 50 | | | 5 | 0.26 | 1.92 | 84 | 7 | 9 |
| 8 | 40 | | | 50 | 10 | | 0.25 | 1.91 | 88 | 4 | 18 |
| 9 | | 45 | 50 | | 5 | | 0.26 | 1.92 | 85 | 9 | 7 |
| 10 | | 45 | | 50 | 5 | | 0.26 | 1.92 | 83 | 8 | 9 |
| 11 | | 45 | | 50 | | 5 | 0.27 | 1.93 | 85 | 9 | 7 |
| 12 | 20 | 25 | 50 | | 5 | | 0.27 | 1.93 | 84 | 9 | 7 |

COMPARATIVE EXAMPLES 1 to 2

With respect to Comparative Example 1, a Ni-Al alloy powder composite coated electrode was prepared by the coating method of Example 12 in Japanese patent publication No. 112785/1979. With respect to Comparative Example 2, a Co-Al alloy powder composite coated electrode was prepared by the coating method of Example 12 of the same publication except that the coating method was modified by replacing $NiCl_2.6H_2O$ and the Ni plate anode by $CoCl_2.6H_2O$ (concentration:

300 g/l) and a Co plate anode, respectively. With respect to each electrode, the metal particles on the electrode were partially sampled and their composition was examined. The results are shown in Table 2.

The tests for the electrolysis of water were conducted in the same manner as in Examples 1 to 12. The results are shown in Table 2.

COMPARATIVE EXAMPLES 3 to 6

Anodes were prepared in the same manner as the Examples except that the alloy powder compositions were changed to those of Comparative Examples 3 to 6 as identified in Table 2. The results of the tests for the electrolysis of water conducted in the same manner as in the Examples are also shown in Table 2.

Comparative Examples 3 and 4 show that even if the third component is incorporated in a great amount, no further improvement of the properties is obtained. Comparative Examples 5 and 6 show that if the metal compositions of the starting material powders are outside the preferred range, the oxygen overvoltage is greater from the biginning.

Table 2

| Comparative Examples | X (%) | | Y (%) | | Z (%) | | Oxygen overvoltage | Cell voltage | Composition after the NaOH treatment (%) | | |
|---|---|---|---|---|---|---|---|---|---|---|---|
| No. | Ni | Co | Al | Zn | Rh | Ir | (V) | (V) | X | Y | Z |
| 1 | 50 | | 50 | | | | 0.35 | 2.01 | 93 | 7 | 0 |
| 2 | | 50 | 50 | | | | 0.36 | 2.02 | 94 | 6 | 0 |
| 3 | 5 | | 55 | | 40 | | 0.24 | 1.90 | 11 | 8 | 81 |
| 4 | 5 | | 45 | | | 50 | 0.24 | 1.90 | 8 | 7 | 85 |
| 5 | 80 | | 10 | | 10 | | 0.38 | 2.04 | 83 | 5 | 12 |
| 6 | 80 | | | 10 | | 10 | 0.40 | 2.06 | 84 | 5 | 11 |

EXAMPLES 13 to 16

Accelerated durability tests of electrodes were conducted by using the electrodes of Examples 2, 4, 7 and 11 as the anodes, a nickel expanded metal as the cathode and a laminate of 5 sheets of cloth made of a copolymer of ethylene with tetrafluoroethylene (COP with an opening of about 100 mesh, manufactured by Asahi Glass Company Ltd.) as the diaphragm. Electrolysis was continued for 15 days at a current density of 500 A/cm$^2$. After the tests, the increase of the oxygen overvoltage at a current density of 70 A/dm$^2$ was investigated. With respect to the electrodes of Examples 2, 4, 7 and 11, the increase of the oxygen overvoltage was found to be +10 mV, 0 mV, +5 mV and +5 mV, respectively.

After the tests, electrolysis of water was conducted in the same manner as in Examples 1 to 12, whereby the cell voltage was found to be 1.93 V, 1.91 V, 1.925 V and 1.935 V, respectively, with respect to the electrodes of Examples 2, 4, 7 and 11.

COMPARATIVE EXAMPLES 7 and 8

With respect to the electrodes of Comparative Examples 1 and 2, accelerated durability tests of electrodes were conducted in the same manner as in Examples 13 to 16, whereby the increase of the oxygen overvoltage was found to be +60 mV and +70 mV, respectively.

After the tests, electrolysis of water was conducted in the same manner as in Examples 1 to 12, whereby the cell voltage was found to be 2.07 V and 2.09 V, respectively, with respect to the electrodes of Comparative Examples 1 and 2.

EXAMPLE 17

In a nickel cheloride bath ($NiCl_2.6H_2O$: 300 g/l, $H_3BO_3$ 38 g/l and $AlCl_3.6H_2O$: 80 g/l), about 2.4 cc/l (i.e. 10 g/l) of non-developed Raney nickel alloy powder (Ni: 50%, Al: 50%, 200 mesh pass) manufactured by Kawaken Fine Chemical Co. was dispersed. On the other hand, rhodium black was prepared in the following manner: To a 0.25M rhodium chloride aqueous solution, potassium hydroxide was added to bring the solution to alkaline (i.e. pH=14). While vigorously stirring the solution, sodium boron hydride was added in a great excess. The resulting rhodium black was collected by filtration, thoroughly washed with pure water and dried in air for more than a day. The rhodium black powder (from 1 to 10 m) thus obtained was dispersed at a concentration of 1 g/l. While thoroughly stirring the dispersion, dispersion plating was conducted by using a Ni plate as the anode and a nickel expanded metal as the cathode. The plating was carried out for 30 minutes at 45° C. at pH 2.5 at a current density of 5 A/dm$^2$, whereby a blackish gray coating layer was formed on the nickel expanded metal.

From the analysis, the coating layer was found to contain 1.59 g of Ni, 1.45 g of Raney nickel alloy and 0.20 g of rhodium per 1 dm$^2$. The volume ratio of the Raney nickel alloy to the nickel was 66:34. The electrode was treated at 80° C. for 1 hour in a 25% NaOH aqueous solution to leach out Al in the Raney nickel alloy. The porosity of the coating layer was 44% by volume. The average diameter of the pores in the coating layer was 45 μm. The oxygen overvoltage of the electrode was measured in a 15% KOH aqueous solution at 110° C. at a current density of 70 A/dm$^2$, and was found to be about 280 mV.

A test for the electrolysis of water was conducted in the same manner as in Examples 1 to 12 by using the electrode as the anode, whereby the cell voltage was found to be 1.94 V.

EXAMPLE 18

In the same manner as in Example 17, a dispersion plated electrode was prepared by using a plating bath in which the rhodium black powder was dispersed at a concentration of 2 g/l. The coating layer was found to contain 1.59 g of Ni, 1.45 g of Raney nickel alloy and 0.45 g of rhodium. The volume ratio of the Raney nickel alloy to the nickel was 66:34. After the leaching of Al in the Raney nickel alloy, the oxygen overvoltage was found to be about 270 mV. The porosity of the coating layer and the average pore diameter were 44% by volume and 45 μm, respectively.

A test for the electrolysis of water was conducted in the same manner as in Examples 1 to 12 by using the electrode as the anode, whereby the cell voltage was found to be 1.93 V.

EXAMPLE 19

Dispersion plating was conducted in the same manner as in Example 17 except that the concentration of the dispersed Raney nickel alloy powder was changed to about 1.2 cc/l (i.e. 5 g/l). The coating layer thereby formed was found to contain 1.59 g of Ni, 1.15 g of Raney nickel alloy and 0.24 g of rhodium. The volume ratio of the Raney nickel alloy to the nickel was 60:40. The oxygen overvoltage was about 280 mV. The porosity of the coating layer and the average pore diameter were 54% by volume and 50 μm, respectively.

A test for the electrolysis of water was conducted in the same manner as in Examples 1 to 12 by using the electrode as the anode, whereby the cell voltage was found to be 1.94 V.

EXAMPLE 20

Dispersion plating was conducted in the same manner as in Example 17 except that the concentration of the dispersed Raney nickel alloy powder was changed to about 3.6 cc/l (i.e. 15 g/l). The coating layer thereby formed was found to contain 1.59 g of Ni, 1.58 g of Raney nickel alloy and 0.28 g of rhodium. The volume ratio of the Raney nickel alloy to the nickel was 68:32. The oxygen overvoltage was about 280 mV. The porosity of the coating layer and the average pore diameter were 62% by volume and 60 μm, respectively.

A test for the electrolysis of water was conducted in the same manner as in Examples 1 to 12 by using the electrode as the anode, whereby the cell voltage was found to be 1.94 V.

EXAMPLE 21

A dispersion plated electrode was prepared in the same manner as in Example 17. However, instead of the Raney nickel alloy powder, Raney cobalt alloy powder having a particle size of at most 200 mesh was used. Further, iridium black (from 0.5 to 5 μm) was used as the noble metal powder. $CoCl_2.6H_2O$ was used instead of $NiCl_2.6H_2O$, and a cobalt plate anote was used instead of the nickel plate anode.

From the analysis, the coating layer was found to contain 1.60 g of Co, 1.46 g of Raney cobalt and 0.23 g of iridium. The oxygen overvoltage was measured and found to be about 280 mV. The volume ratio of the Raney cobalt alloy to the cobalt in the coating layer was 66:34. The porosity of the coating layer and the average pore diameter were 44% by volume and 47 m, respectively.

A test for the electrolysis of water was conducted in the same manner as in Examples 1 to 12 by using the electrode as the anode, whereby the cell voltage was found to be 1.94 V.

EXAMPLE 22

A dispersion plated electrode was prepared in the same manner as in Example 17. However, fine iridium black powder (from 0.5 to 5 μm) was used instead of the rhodium black powder. The oxygen overvoltage was about 320 mV. The volume ratio of the Raney nickel to the nickel in the coating layer, the porosity of the coating layer and the average pore diameter were the same as in Example 17.

As test for the electrolysis of water was conducted in the same manner as in Examples 1 to 12 by using the electrode as the anode, whereby the cell voltage was found to be 1.98 V.

COMPARATIVE EXAMPLE 7

Dispersion plating was conducted in the same manner as in Example 17 except that no Raney nickel alloy powder was used. The rhodium content in the coating layer was 0.20 g. The oxygen overvoltage was measured and found to be about 420 mV. From the microscopic observation of the cross section of the coating layer, it was found that the majority of the rhodium particles were completely embedded in the nickel layer. The porosity of the coating layer and the average pore diameter were 6% by volume and 3 μm, respectively.

A test for the electrolysis of water was conducted in the same manner as in Examples 1 to 12 by using the electrode as the anode, whereby the cell voltage was found to be 2.10 V, and the anode overvoltage was found to be about 440 mV.

What is claimed is:

1. A cell for the electrolysis of water comprising an anode and a cathode wherein said anode comprises an electrode substrate and a coating layer formed on the substrate, said coating layer being made of an electrochemically active material comprising Component X selected from the group consisting of nickel, cobalt and mixture thereof, Component Y selected from the group consisting of aluminum, zinc, magnesium and silicon and Component Z selected from the group consisting of a noble metal and rhenium.

2. The cell according to claim 1, wherein said coating layer is composed of uniform layer of said electrochemically active material.

3. The cell according to claim 1, wherein said coating layer is composed of particles of said electrochemically active particles.

4. The cell according to claim 1, wherein said coating layer is composed of a uniform layer of a bonding metal and particles of said electrochemically active material embedded in and partially exposed from the uniform layer.

5. The cell according to claim 4, wherein said bonding metal is composed of said electrochemically active material.

6. The cell according to claim 4 wherein said bonding metal is nickel, cobalt or silver.

7. The cell according to claim 1, wherein said electrochemically active material is an alloy having a composition of Components X, Y and Z falling within the range defined by the following points A, B, C and D with reference to the diagram of FIG. 1:

| | | | |
|---|---|---|---|
| A: | X = 99.6 wt. %, | Y = 0 wt. %, | Z = 0.4 wt. % |
| B: | X = 79.6 wt. %, | Y = 20 wt. %, | Z = 0.4 wt. % |
| C: | X = 40 wt. %, | Y = 20 wt. %, | Z = 40 wt. % |
| D: | X = 40 wt. %, | Y = 0 wt. %, | Z = 60 wt. % |

8. The cell according to claim 4, wherein said particles are a mixture of particles of an alloy of Components X and Y and particles of a metal of Component Z or its alloy or oxide.

9. In a process for producing oxygen and hydrogen by electrolyzing an aqueous alkaline solution in an electrolytic cell comprising an anode and a cathode, the improvement comprising an anode comprising an electrode substrate and a coating layer formed on the substrate, said coating layer being made of an electrochemically active material comprising Component X selected from the group consisting of nickel, cobalt and mixture thereof, Component Y selected from the group consisting of aluminum, zinc, magnesium and silicon and Component Z selected from the group consisting of a noble metal and rhenium.

* * * * *

UNITED STATES PATENT AND TRADEMARK OFFICE

CERTIFICATE OF CORRECTION

PATENT NO. : 4,498,962

DATED : February 12, 1985

INVENTOR(S) : Oda et al.

It is certified that error appears in the above-identified patent and that said Letters Patent is hereby corrected as shown below:

Title page, Item [30] should read:

-- October 7, 1982 [JP] Japan ..... 57-175376
October 7, 1982 [JP] Japan ..... 57-175375 - -

Signed and Sealed this

*Twenty-fifth* Day of *June 1985*

[SEAL]

*Attest:*

DONALD J. QUIGG

*Attesting Officer*

*Acting Commissioner of Patents and Trademarks*